US008584426B2

(12) United States Patent
Valler et al.

(10) Patent No.: US 8,584,426 B2
(45) Date of Patent: Nov. 19, 2013

(54) SASH BINDER

(75) Inventors: Jess J. Valler, Olympia, WA (US); Melvin Saunders, Auburn, WA (US)

(73) Assignee: Milgard Manufacturing Incorporated, Tacoma, WA (US)

( * ) Notice: Subject to any disclaimer, the term of this patent is extended or adjusted under 35 U.S.C. 154(b) by 0 days.

(21) Appl. No.: 12/794,618

(22) Filed: Jun. 4, 2010

(65) Prior Publication Data

US 2011/0296776 A1 Dec. 8, 2011

(51) Int. Cl.
*E06B 3/667* (2006.01)
*E06B 3/964* (2006.01)
*E06B 3/673* (2006.01)

(52) U.S. Cl.
USPC ..... 52/656.5; 52/204.6; 52/204.62

(58) Field of Classification Search
USPC ..... 52/204.6, 204.62, 204.69, 204.7, 656.5, 52/204.54, 656.6; 49/432, 433, 434, 435, 49/444, 489.1
See application file for complete search history.

(56) References Cited

U.S. PATENT DOCUMENTS

| | | | | |
|---|---|---|---|---|
| 1,966,196 | A * | 7/1934 | Benoit | 49/459 |
| 3,750,333 | A | 8/1973 | Vance | |
| 4,373,295 | A | 2/1983 | Starck | |
| 4,399,636 | A | 8/1983 | Blackwell | |
| 4,527,807 | A | 7/1985 | Urbanick | |
| 4,606,147 | A * | 8/1986 | DeWitt et al. | 49/434 |
| 4,660,338 | A | 4/1987 | Wagner | |
| 4,821,472 | A | 4/1989 | Tix | |
| 4,848,962 | A | 7/1989 | Whipps | |
| 4,976,067 | A | 12/1990 | Maass | |
| 4,979,346 | A | 12/1990 | Pollard | |
| 4,981,001 | A | 1/1991 | Furuminato | |
| 5,007,221 | A | 4/1991 | Matthews et al. | |
| 5,038,538 | A | 8/1991 | Rozon | |
| 5,048,252 | A | 9/1991 | Osborn | |
| 5,069,013 | A | 12/1991 | Pliml | |
| 5,083,409 | A | 1/1992 | Pliml | |
| 5,174,091 | A | 12/1992 | Stokx | |
| 5,323,579 | A | 6/1994 | Ruff | |
| 5,325,648 | A | 7/1994 | Menard | |
| 5,373,672 | A | 12/1994 | Schulz | |

(Continued)

FOREIGN PATENT DOCUMENTS

| | | | |
|---|---|---|---|
| AT | 308361 | B1 | 3/1970 |
| CA | 2282209 | A | 7/2000 |

(Continued)

*Primary Examiner* — Brian Glessner
*Assistant Examiner* — Rodney Mintz
(74) *Attorney, Agent, or Firm* — Rathe Lindenbaum LLP

(57) ABSTRACT

Another exemplary embodiment relates to a sash assembly. The sash assembly includes an outer sash having at least one groove, an inner sash having at least one groove, and a removable binder extending along a perimeter of a surface of the outer sash and inner sash. The binder is configured to engage the outer sash and the inner sash and to mechanically couple the outer sash and the inner sash together. The binder includes a plurality of protrusions. Each protrusion is configured to mate with one of the groove in the inner sash and the groove in the outer sash. Each protrusion includes a plurality of flexible barbs that are compressed when the protrusion mates with one of the grooves. The flexible barbs provide a force on interior edges of the groove to couple the inner sash and outer sash together. The binder is configured for removal for service of the sash assembly.

17 Claims, 3 Drawing Sheets

(56) References Cited

U.S. PATENT DOCUMENTS

| | | | | |
|---|---|---|---|---|
| 5,408,784 | A | 4/1995 | Wruck et al. | |
| 5,414,962 | A | 5/1995 | Forbis et al. | |
| 5,430,982 | A | 7/1995 | Bane | |
| 5,435,106 | A | 7/1995 | Garries et al. | |
| 5,540,019 | A | 7/1996 | Beske et al. | |
| 5,548,929 | A | 8/1996 | Larsen et al. | |
| 5,557,894 | A | 9/1996 | Card | |
| 5,560,154 | A | 10/1996 | Matarazzo | |
| 5,566,524 | A | 10/1996 | Bettin | |
| 5,570,548 | A * | 11/1996 | Hopper | 52/204.5 |
| 5,622,017 | A * | 4/1997 | Lynn et al. | 52/209 |
| 5,642,593 | A | 7/1997 | Shieh | |
| 5,678,383 | A | 10/1997 | Danielewicz | |
| 5,758,459 | A * | 6/1998 | Koike et al. | 52/235 |
| 5,768,837 | A | 6/1998 | Sjoholm | |
| 5,772,190 | A | 6/1998 | May et al. | |
| 5,797,229 | A * | 8/1998 | Alvarez et al. | 52/204.62 |
| 5,817,414 | A | 10/1998 | Ando | |
| 5,992,107 | A | 11/1999 | Poirier | |
| 6,016,632 | A | 1/2000 | McGee et al. | |
| 6,047,507 | A | 4/2000 | Lappin et al. | |
| 6,050,617 | A | 4/2000 | Prevot et al. | |
| 6,148,584 | A | 11/2000 | Wilson | |
| 6,205,723 | B1 * | 3/2001 | Farrar et al. | 52/202 |
| 6,263,626 | B1 * | 7/2001 | Gerhardt | 52/204.5 |
| 6,341,449 | B1 * | 1/2002 | Stahl | 49/458 |
| 6,353,981 | B1 | 3/2002 | Smith | |
| 6,401,410 | B2 * | 6/2002 | Kenny et al. | 52/235 |
| 6,467,226 | B2 * | 10/2002 | Dodson et al. | 52/220.1 |
| 6,490,831 | B1 | 12/2002 | Candusso | |
| 6,523,311 | B2 | 2/2003 | Edger | |
| D477,090 | S | 7/2003 | Thomsen et al. | |
| 6,662,512 | B2 | 12/2003 | Westphal | |
| 6,671,934 | B2 | 1/2004 | Wenzlick et al. | |
| 6,688,044 | B2 * | 2/2004 | Farrar et al. | 49/375 |
| 6,722,089 | B2 | 4/2004 | Budzinski | |
| 6,745,523 | B2 | 6/2004 | Petta | |
| 6,857,233 | B2 | 2/2005 | Farag | |
| 6,925,767 | B2 * | 8/2005 | Krochmal et al. | 52/455 |
| 6,974,518 | B2 * | 12/2005 | Hornung et al. | 156/109 |
| 7,010,888 | B2 * | 3/2006 | Tumlin et al. | 52/204.56 |
| 7,013,604 | B1 | 3/2006 | Moody et al. | |
| 7,036,275 | B2 | 5/2006 | Quesada | |
| 7,120,971 | B2 | 10/2006 | Osterland et al. | |
| 7,246,466 | B2 * | 7/2007 | Turner | 49/504 |
| 7,278,241 | B2 | 10/2007 | Wirawan | |
| D565,199 | S | 3/2008 | Westphal | |
| 7,448,174 | B2 * | 11/2008 | Krochmal et al. | 52/204.54 |
| 7,490,445 | B2 * | 2/2009 | Steffek et al. | 52/456 |
| 7,520,094 | B2 | 4/2009 | Davies | |
| 7,555,871 | B1 | 7/2009 | Neal | |
| 7,596,912 | B2 | 10/2009 | Ito et al. | |
| 7,634,880 | B2 * | 12/2009 | Sironko et al. | 52/456 |
| 7,640,634 | B2 | 1/2010 | Vassiliou | |
| 7,698,871 | B2 * | 4/2010 | Mansueto et al. | 52/656.9 |
| 7,765,769 | B2 * | 8/2010 | Rosskamp et al. | 52/786.1 |
| 7,784,239 | B2 * | 8/2010 | Mansueto et al. | 52/656.9 |
| 7,845,135 | B2 * | 12/2010 | Sibbett | 52/656.9 |
| 7,845,139 | B1 * | 12/2010 | Mansueto et al. | 52/745.15 |
| 7,971,623 | B2 * | 7/2011 | Barnard et al. | 160/116 |
| 8,083,271 | B2 * | 12/2011 | Vilhauer | 292/137 |
| 8,182,001 | B2 * | 5/2012 | Tremble et al. | 292/32 |
| 8,196,355 | B1 | 6/2012 | Mccabe et al. | |
| 8,245,462 | B2 * | 8/2012 | Miethe et al. | 52/204.7 |
| 8,286,388 | B2 * | 10/2012 | Zhao et al. | 49/74.1 |
| 8,322,090 | B2 * | 12/2012 | Moriya et al. | 52/204.591 |
| 8,322,091 | B2 * | 12/2012 | Smith et al. | 52/208 |
| 8,353,138 | B2 * | 1/2013 | Sigmund et al. | 52/209 |
| 8,448,394 | B2 * | 5/2013 | Miethe et al. | 52/204.7 |
| 2002/0059758 | A1 * | 5/2002 | Dodson et al. | 52/204.1 |
| 2002/0062609 | A1 * | 5/2002 | Farrar et al. | 52/204.5 |
| 2003/0056442 | A1 * | 3/2003 | Gerard | 49/504 |
| 2003/0089054 | A1 * | 5/2003 | Hornung | 52/204.62 |
| 2003/0217523 | A1 | 11/2003 | Budzinski | |
| 2004/0068942 | A1 * | 4/2004 | Krochmal et al. | 52/204.71 |
| 2005/0028458 | A1 * | 2/2005 | Rosskamp et al. | 52/172 |
| 2005/0081981 | A1 | 4/2005 | Heikkila | |
| 2005/0097841 | A1 | 5/2005 | Milligan et al. | |
| 2006/0156633 | A1 | 7/2006 | Guhl et al. | |
| 2006/0185294 | A1 | 8/2006 | Langer et al. | |
| 2007/0137109 | A1 * | 6/2007 | Tremble et al. | 49/185 |
| 2007/0186495 | A1 * | 8/2007 | Guillemette | 52/204.51 |
| 2007/0289220 | A1 * | 12/2007 | Vilhauer | 49/449 |
| 2008/0016800 | A1 * | 1/2008 | Tufts et al. | 52/204.6 |
| 2008/0104892 | A1 | 5/2008 | Cox et al. | |
| 2008/0110094 | A1 | 5/2008 | Davies | |
| 2008/0202046 | A1 | 8/2008 | Fujii | |
| 2008/0216424 | A1 | 9/2008 | Westphal et al. | |
| 2009/0000225 | A1 | 1/2009 | Ito et al. | |
| 2009/0019774 | A1 * | 1/2009 | Zhao et al. | 49/74.1 |
| 2009/0119874 | A1 | 5/2009 | Kellum et al. | |
| 2009/0145064 | A1 * | 6/2009 | Hornung et al. | 52/204.62 |
| 2009/0158677 | A1 * | 6/2009 | Liang et al. | 52/204.62 |
| 2009/0277111 | A1 | 11/2009 | Albrecht et al. | |
| 2009/0293387 | A1 * | 12/2009 | Miethe et al. | 52/204.62 |
| 2010/0071303 | A1 * | 3/2010 | Mansueto et al. | 52/656.7 |
| 2010/0083597 | A1 * | 4/2010 | Addison et al. | 52/204.53 |
| 2010/0146883 | A1 * | 6/2010 | Benkel | 52/204.64 |
| 2010/0154330 | A1 * | 6/2010 | Schultz et al. | 52/204.61 |
| 2010/0154346 | A1 * | 6/2010 | Mansueto et al. | 52/656.2 |
| 2010/0263307 | A1 * | 10/2010 | Gilles et al. | 52/213 |
| 2010/0325890 | A1 * | 12/2010 | Mansueto et al. | 29/897.3 |
| 2011/0011002 | A1 * | 1/2011 | Guillemette | 49/394 |
| 2011/0023407 | A1 * | 2/2011 | Wang | 52/656.5 |
| 2011/0308169 | A1 * | 12/2011 | Lambertini | 49/417 |
| 2012/0005975 | A1 * | 1/2012 | Kim | 52/209 |
| 2012/0042574 | A1 * | 2/2012 | DeBoer et al. | 49/449 |
| 2012/0131867 | A1 * | 5/2012 | Smith | 52/204.1 |
| 2012/0204505 | A1 * | 8/2012 | Sigmund et al. | 52/209 |
| 2012/0279136 | A1 * | 11/2012 | Miethe et al. | 49/404 |
| 2012/0279166 | A1 * | 11/2012 | Valler et al. | 52/656.2 |
| 2012/0285091 | A1 * | 11/2012 | Zhao et al. | 49/74.1 |
| 2013/0000232 | A1 * | 1/2013 | Weiss et al. | 52/204.6 |

FOREIGN PATENT DOCUMENTS

| | | | |
|---|---|---|---|
| CA | 2343865 | A | 6/2002 |
| CN | 2197450 | Y | 5/1995 |
| DE | 3844195 | A | 7/1990 |
| EP | 446776 | A | 9/1991 |
| EP | 392342 | B1 | 12/1993 |
| EP | 0657612 | A | 6/1995 |
| EP | 767727 | A | 4/1997 |
| FR | 2516122 | A | 5/1983 |
| GB | 1241669 | A | 8/1971 |
| WO | 8803218 | A | 5/1988 |
| WO | 9816710 | A | 4/1998 |
| WO | 9960242 | A | 11/1999 |
| WO | 0047853 | A | 8/2000 |
| WO | WO 2011153479 | A1 * | 12/2011 |

* cited by examiner 10
14
18
12
5
5
16

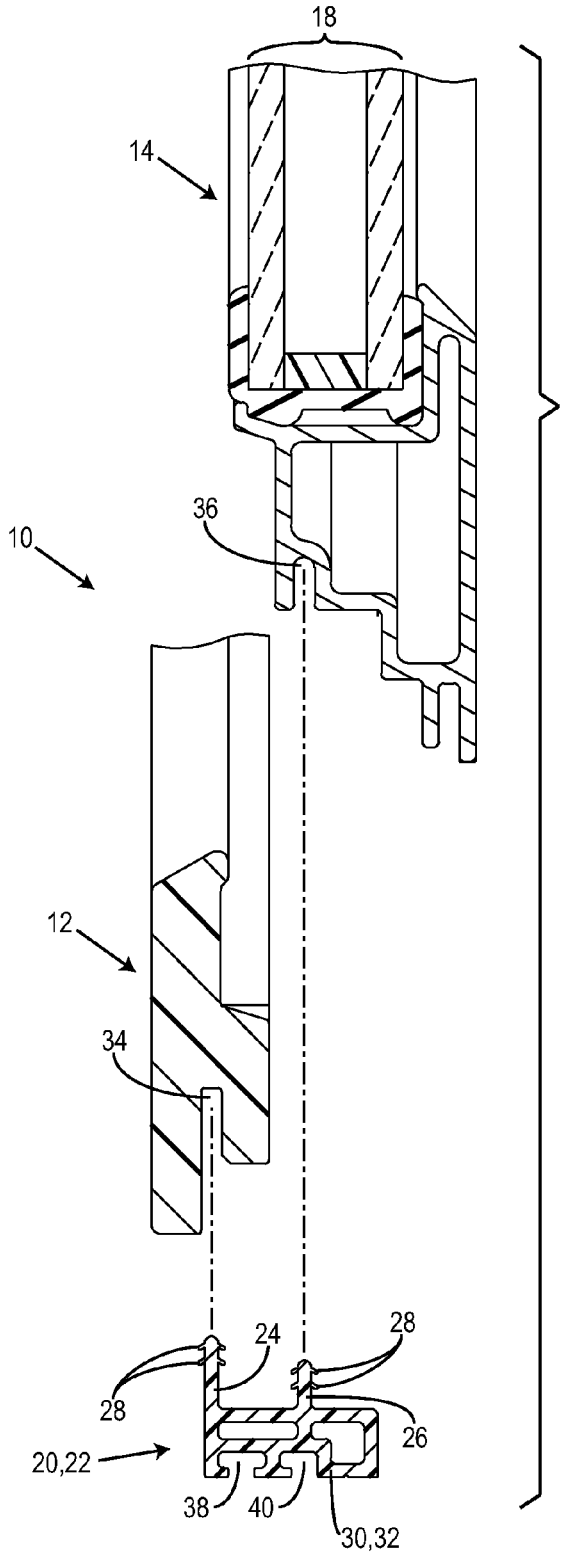
FIG. 4
FIG. 5
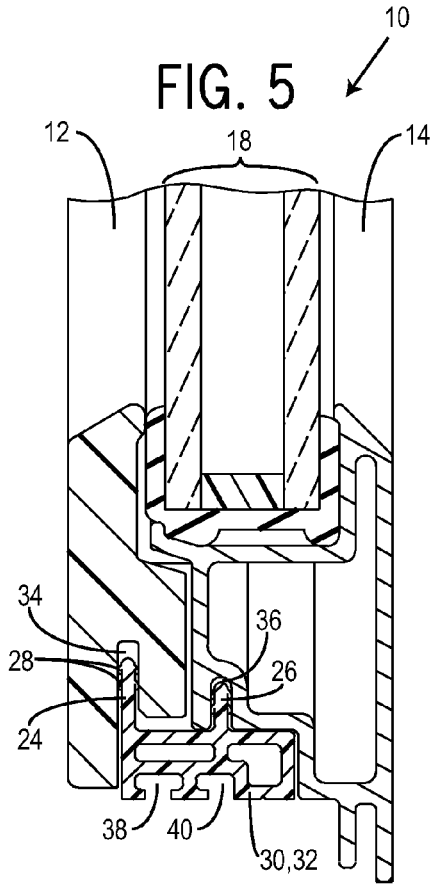

SASH BINDER

BACKGROUND

The present invention relates generally to the field of window construction. Some window designs include an outer sash that houses the glass of the window and an inner sash that couples to the outer sash to enclose the glass and provide decorative features. When the window is installed in a building, the outer sash faces the exterior of the building while the inner sash faces the interior of the building. The inner and outer sashes are conventionally adhered together using glue or other adhesive material. Such adhesion makes servicing of the window difficult. For example, removal of the glass for repair or replacement can be quite difficult because the inner and outer sashes are permanently glued together. Removal of the glue or separation of the inner and outer sashes can cause damage to the window.

SUMMARY

One exemplary embodiment of the invention relates to a removeably engageable window binder. The binder is configured to extend along a perimeter of a surface of an outer sash and inner sash. The binder is configured to engage the outer sash and the inner sash and to mechanically couple the outer sash and the inner sash together. The binder includes a plurality of protrusions. Each protrusion is configured to mate with one of a groove in the inner sash and a groove in the outer sash. Each protrusion includes a plurality of flexible barbs that are compressed when the protrusion mates with one of the grooves. The flexible barbs provide a force on interior edges of the groove to couple the inner sash and outer sash together.

The flexible barbs may also provide a force on interior edges of the groove to seal the inner sash and outer sash together.

Another exemplary embodiment relates to a sash assembly. The sash assembly includes an outer sash having at least one groove, an inner sash having at least one groove, and a removable binder extending along a perimeter of a surface of the outer sash and inner sash. The binder is configured to engage the outer sash and the inner sash and to mechanically couple the outer sash and the inner sash together. The binder includes a plurality of protrusions. Each protrusion is configured to mate with one of the groove in the inner sash and the groove in the outer sash. Each protrusion includes a plurality of flexible barbs that are compressed when the protrusion mates with one of the grooves. The flexible barbs provide a force on interior edges of the groove to couple the inner sash and outer sash together. The binder is configured for removal for service of the sash assembly.

Another exemplary embodiment relates to a sash assembly. The sash assembly includes an outer sash having at least one groove, an inner sash having at least one groove, and a binder extending along a perimeter of a surface of the outer sash and inner sash. The binder is configured to removably engage the outer sash and the inner sash and to mechanically couple the outer sash and the inner sash together. The binder includes a plurality of protrusions. Each protrusion is configured to mate with one of the groove in the inner sash and the groove in the outer sash. Each protrusion includes a plurality of flexible barbs that are compressed when the protrusion mates with one of the grooves. The flexible barbs provide a force on interior edges of the groove to couple the inner sash and outer sash together.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

FIG. 4 is a partial cross-sectional and exploded view of an inner sash, an outer sash, and a binder of the sash assembly of FIG. 1, according to an exemplary embodiment.

FIG. 5 is a partial cross-sectional view of the sash assembly of FIG. 1, according to an exemplary embodiment.

DETAILED DESCRIPTION

Figure 1:
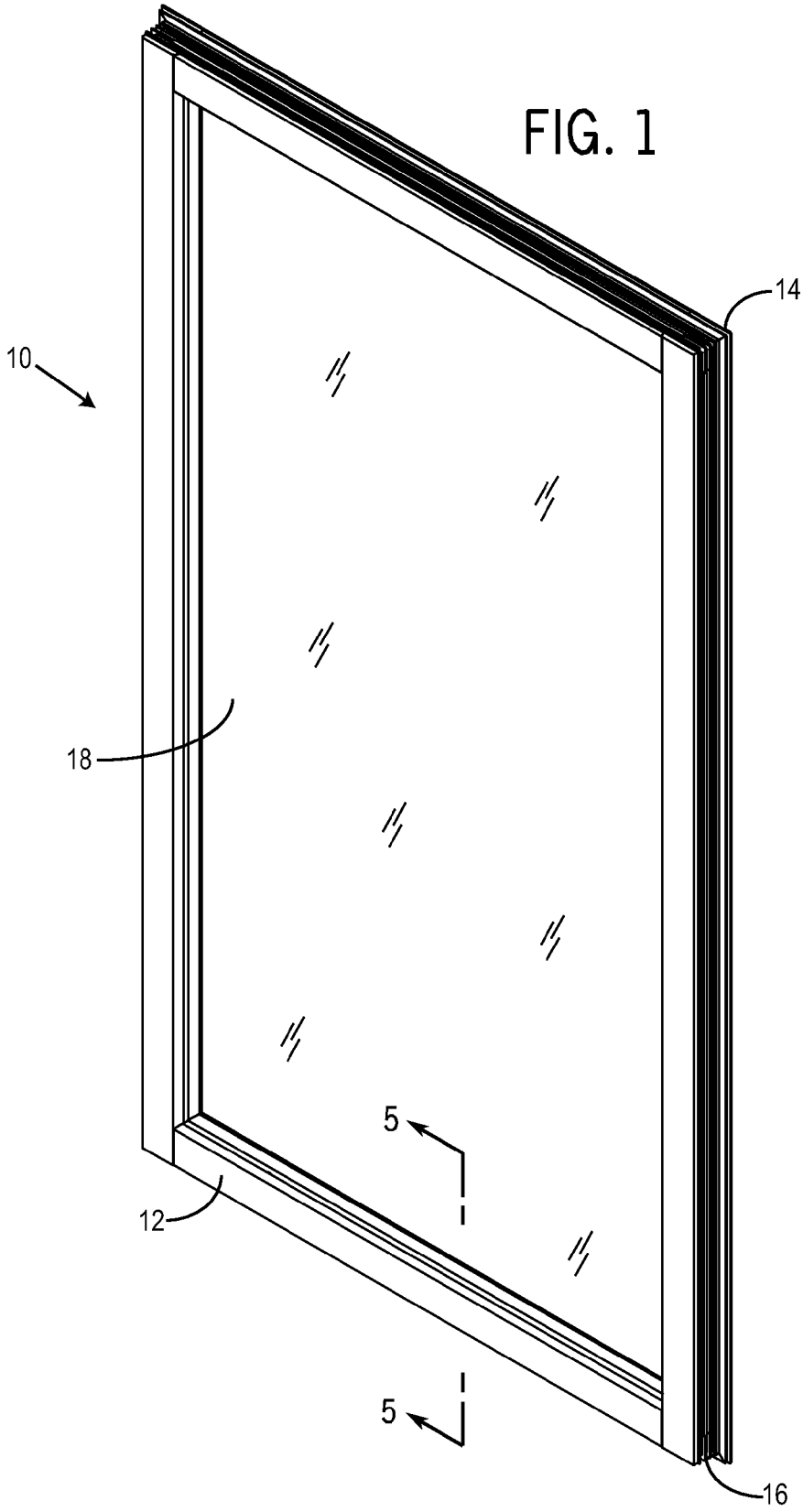
FIG. 1 is a perspective view of a sash assembly, according to an exemplary embodiment.

Referring to FIG. 1, a sash assembly 10 (e.g., for a window) includes an inner sash 12, an outer sash 14, and a binder 16, according to an exemplary embodiment. The outer sash 14 houses at least one pane of glazing or glass 18. Binder 16 is generally configured to engage with inner sash 12 and outer sash 14 to mechanically couple inner sash 12 and outer sash 12 together without gluing, as will be described in greater detail below. Binder 16 may be removed to provide easy servicing of sash assembly 10, for example to replace or repair glass 18, inner sash 12, and/or outer sash 14.

Inner sash 12 and outer sash 14 may be similar to conventional sashes in structure and design. Inner sash 12 and outer sash 14 may be made of wood, a vinyl material, a composite material, a plastic material, an aluminum material, a steel material, an combination thereof, or any other material suitable for a window.

According to various exemplary embodiments, glazing 18 may include a single pane of glass, double panes of glass, triple panes of glass or any other number of panes. Any space between multiple panes of glass 18 may be filled with air, argon, krypton, a vacuum, or any other substance. Glass 18 may be made of any type of glass material (e.g., soda lime glass, alkali silicate glass, etc.) of any thickness and may include any features of past, present, or future design (e.g., a low-E coating, lamination, tinting, impact resistance, shatter resistance, etc.) Glazing 18 may also be formed of any other type of window material such as plastic.

Figure 2:
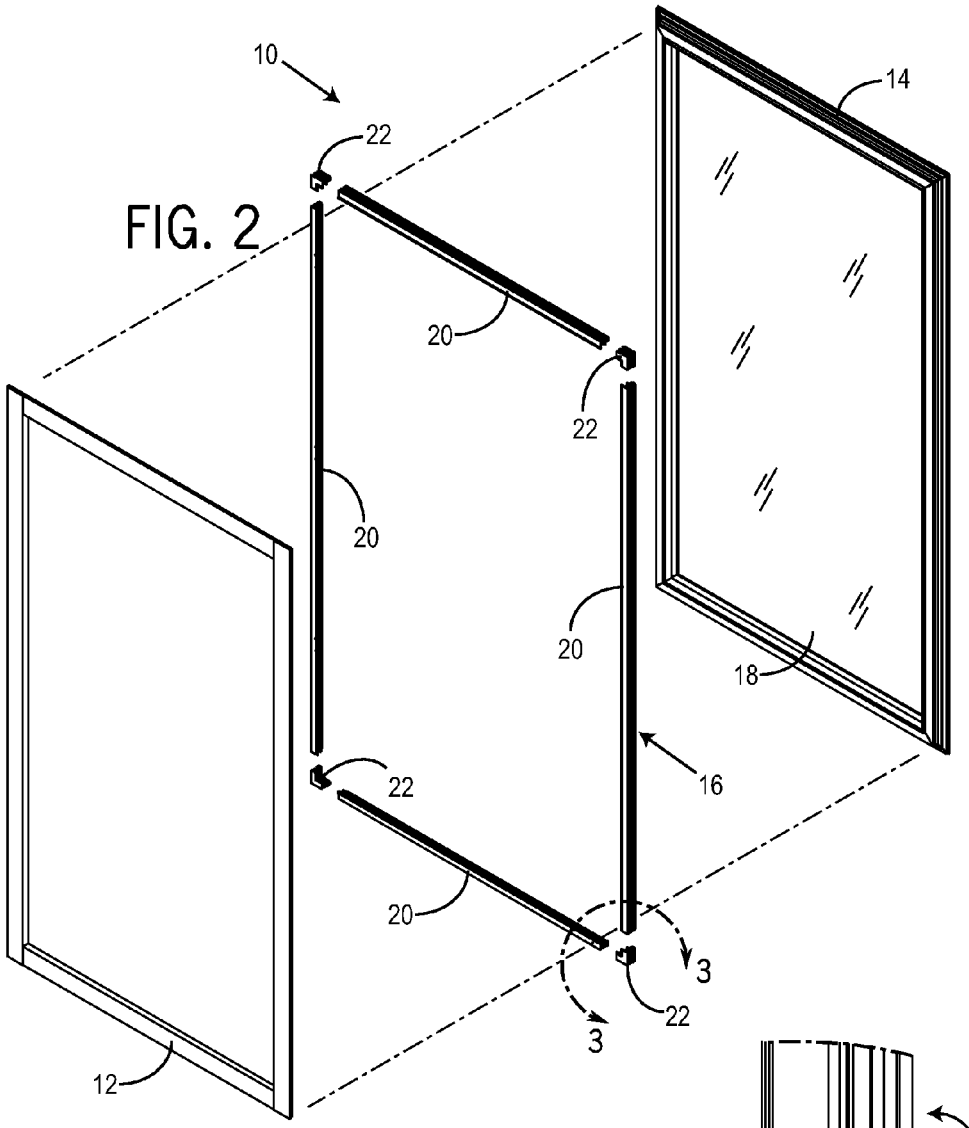
FIG. 2 is an exploded view of the sash assembly of FIG. 1, according to an exemplary embodiment.

Referring now to FIG. 2, an exploded view of sash assembly 10 illustrates binder 16 in greater detail, according to one exemplary embodiment. In one embodiment binder 16 extends completely around the perimeter of a surface of inner sash 12 and outer sash 14 in order to couple the sashes together and to seal the interface between inner sash 12 and outer sash 14 from air and/or moisture. However in other embodiments, binder 16 may extend around only a portion of the perimeter of the surface of the inner sash 12 and outer sash 14. Binder 16 may be located at an outside portion of sash assembly 10. Such an orientation may allow for a variation in tolerance between outer sash 14 and inner sash 12 because of how outer sash 14 and inner sash 12 are held together. Binder 16 generally includes multiple edge binding members 20 and multiple corner binding members 22. Each edge binding member 20 is configured to mate with an edge of inner sash 12 and outer sash 14. Each edge binding member 20 extends along a majority of the length of the edge of inner sash 12 and outer sash 14. Each corner binding member 22 is configured to mate with a corner of inner sash 12 and outer sash 14. Each corner binding member 22 wraps around a corner of inner sash 12 and outer sash 14 and couples with two edge binding members 20.

Figure 3:
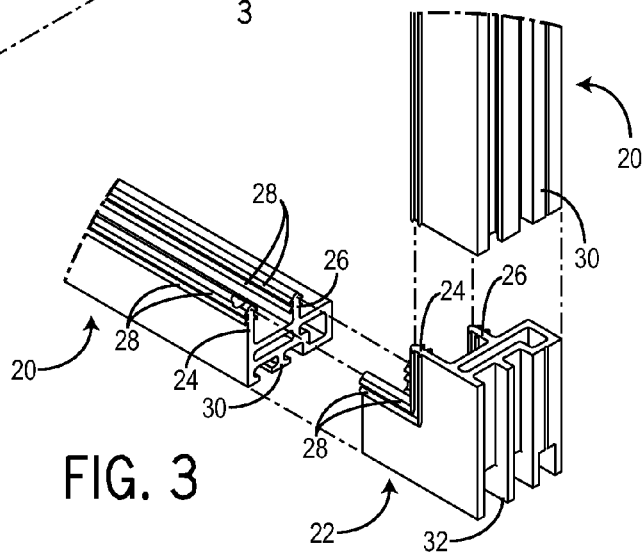
FIG. 3 is a more detailed view of a binder portion of the sash assembly of FIG. 2, according to an exemplary embodiment.

Referring to FIG. 3, a portion of binder 16 is illustrated in greater detail, according to an exemplary embodiment. Each edge binding member 20 and corner binding member 22 includes a protrusion 24 and a protrusion 26 extending along an interior surface of the binding member (e.g., an entirety of the interior surface or a portion of the surface) and configured for mating with inner sash 12 and outer sash 14. Each protrusion 24 and protrusion 26 includes multiple flexible barbs 28 to aid in mating with inner sash 12 and outer sash 14. Barbs 28 may extend from protrusions 24 and 26 on either or both sides of the protrusion. Each protrusion 24 and protrusion 26 is coupled to a base 30 of an edge binding member 20 or a base 32 of a corner binding member 22.

According to various exemplary embodiments, barbs 28 may be made of flexible polyvinyl chloride (PVC), thermoplastic elastomer (TPE), flexible urethane, a rubber based material, or a similar flexible extruded material. According to various exemplary embodiments, protrusions 24, 26 and bases 30, 32 may be made of PVC, polypropylene, acrylonitrile butadiene styrene (ABS), or any other rigid extrudable material.

Referring to FIGS. 4 and 5, a partial exploded view of inner sash 12, outer sash 14, and binder 16 illustrates how binder 16 mates with each of inner sash 12 and outer sash 14, according to an exemplary embodiment. Inner sash 12 includes a groove 34 configured for receiving protrusion 24 while outer sash 14 includes a groove 36 configured for receiving protrusion 26. Grooves 34 and 36 may extend along an entirety of the perimeter of a surface of inner sash 12 and outer sash 14. Barbs 28 are flexible and have a spring force that biases them in an outward direction (e.g., oblique from the corresponding protrusion). When protrusions 24 and 26 are inserted into grooves 34 and 36, respectively, barbs 28 are compressed between protrusions 24 and 26 and the interior edge of grooves 34 and 36 and provide a force to the interior edges of grooves 34 and 36. The force provided by barbs 28 may be sufficient to couple inner sash 12 and outer sash 14 together to withstand the weight of each sash without uncoupling and to provide a seal against air and/or moisture. The location and orientation of binder 16 may allow for a variation in tolerance between outer sash 14 and inner sash 12 because of how barbs 28 and protrusions 24 and 26 mate inner sash 12 and outer sash 14 together. For example, inner sash 12 and outer sash 14 may move with respect to each other (e.g., apart, up, down, etc.) without breaking the seal between inner sash 12 and outer sash 14. Inner sash 12 and/or outer sash 14 may also expand or contract due to weather conditions without breaking the seal between inner sash 12 and outer sash 14.

While the barbs 28 may provide sufficient force for typical usage of sash assembly 10, binder 16 may be easily removed by a person for maintenance or servicing of sash assembly 10. As described above, binder 16 may be removed to facilitate repair or replacement of inner sash 12, outer sash 14, and/or glass 18. In one embodiment, no tools are needed to install or remove the binder 16 to inner sash 12 and outer sash 14. That is a person may be able to remove binder 16 by hand without the need to remove any additional mechanical fasteners. Once binder 16 is removed, it may be possible to reinstall binder 16 to inner sash 12 and outer sash 14 after the sash assembly has been repaired or glazing 18 replaced. The installation, removal, and reinstallation of binder 16 in one embodiment may be completed by a person without the need to use any additional tools.

Binder 16 may also be used to facilitate attachment of window hardware, for aesthetics, for retention of screws (e.g., screws in the window frame), as a weather strip carrier, etc. For example, base 30 or 32 may include a groove 38 and/or a groove 40. Groove 38 or 40 may be configured to receive a section of weather stripping to improve the seal of the window to isolate the interior space from the exterior environment. Groove 38 or 40 may be configured to receive window hardware for actuation or locking of the window. Groove 38 or 40 may be configured to conceal or retain screws or other fasteners in the window frame, inner sash 12, or outer sash 14.

While protrusion 24 is generally shown as extending further from base 30 than protrusion 26, in other exemplary embodiments where the configuration of inner sash 12 and outer sash 14 is different, protrusions 24 and 26 may extend a similar distance or protrusion 26 may extend further than protrusion 24. Further, while two protrusions 24 and 26 are shown, according to other exemplary embodiments, more than two protrusions may be used for additional coupling. Alternatively, binder 16 may include only one protrusion. For example, the binder 16 may be integrally formed or otherwise attached to the inner sash 12 or outer sash 14 and only removably couple to the other of inner sash 12 and outer sash 14.

While each protrusion 24 and 26 are shown to include four barbs 28 with two barbs 28 on each side of each protrusion 24 and 26, according to other exemplary embodiments, each protrusion 24 and 26 may include more than or fewer than four barbs 28 and two barbs 28 on each side. Further, one side of protrusions 24 and 26 may have more or fewer barbs than the opposite side of the protrusion. Further still, protrusion 24 may have a different number and/or distribution of barbs 28 than protrusion 26.

While sash assembly 10 is illustrated as being rectangular, according to other exemplary embodiments, sash assembly 10 may be round, triangular, a pentagon, a hexagon, or any other shape. With such alternate shapes, the configuration and shape of binding members of binder 16 may be adjusted accordingly. For example, for a round window, binder 16 may include a plurality of semicircular or quarter circle corner binding members, for a triangular window, binder 16 may include three edge binding members 20 and three corner binding members 22, etc.

For purposes of this disclosure, the term "coupled" means the joining of two components directly or indirectly to one another. Such joining may be stationary in nature or movable in nature. Such joining may be achieved with the two components (electrical or mechanical) and any additional intermediate members being integrally defined as a single unitary body with one another or with the two components or the two components and any additional member being attached to one another. Such joining may be permanent in nature or alternatively may be removable or releasable in nature.

The present disclosure has been described with reference to exemplary embodiments, however, workers skilled in the art will recognize that changes may be made in form and detail without departing from the spirit and scope of the disclosure. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example is manifestly intended to be as broad as possible. For example, unless specifically otherwise noted a single particular element may also encompass a plurality of such particular elements.

It is also important to note that the construction and arrangement of the elements of the system as shown in the exemplary embodiments is illustrative only. Although only a certain number of embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited.

Further, elements shown as integrally formed may be constructed of multiple parts or elements shown as multiple parts may be integrally formed, the operation of the assemblies may be reversed or otherwise varied, the length or width of the structures and/or members or connectors or other elements of the system may be varied, the nature or number of adjustment or attachment positions provided between the elements may be varied. It should be noted that the elements and/or assemblies of the system may be constructed from any of a wide variety of materials that provide sufficient strength or durability. Accordingly, all such modifications are intended to be included within the scope of the present disclosure. Other substitutions, modifications, changes and omissions may be made in the design, operating conditions and arrangement of the exemplary embodiments without departing from the spirit of the present subject matter.

What is claimed is:

1. A removably engageable window binder system, comprising:

an inner sash having a first wall configured to be adjacent a first surface of a glazing;

an outer sash having a first wall configured to be adjacent a second surface of the glazing that is spaced from and parallel to the first surface of the glazing;

a binder extending along a perimeter of the outer sash and the inner sash, the binder removably engaging the outer sash and the inner sash and mechanically coupling the outer sash and the inner sash together, the binder comprising a first protrusion and a second protrusion parallel to the first protrusion, respectively mating with a first groove located completely in the inner sash that extends in a direction parallel to planes defined by the first surface of the glazing and a second groove parallel to the first groove and located completely in the outer sash, each protrusion comprising a plurality of flexible barbs that are compressed when the protrusion mates with one of the grooves, the flexible barbs providing a force on opposing interior edges of the groove coupling the inner sash and outer sash together, and wherein the first and second protrusions extend respectively along substantially the entire perimeter of the inner sash and the outer sash.

2. The system of claim 1, wherein the binder is configured to seal the inner sash and outer sash from at least one of moisture and air.

3. The system of claim 1, wherein the outer sash houses at least one pane of glass and removal of the binder allows for servicing of the glass.

4. The system of claim 1, wherein each protrusion comprises four barbs.

5. The system of claim 1, wherein the barbs being selected from the group consisting of flexible polyvinyl chloride, thermoplastic elastomer, flexible urethane, and rubber based material.

6. The system of claim 1, wherein the binder comprises a plurality of edge binding members and corner binding members.

7. The system of claim 1, wherein the binder facilitates attachment of window hardware, retention of screws, and retention of weather stripping.

8. A sash assembly, comprising:

a glazing having an outer periphery extending about a first surface and an opposing second surface parallel to the first surface;

an outer sash having a first portion adjacent the first surface of the glazing, the outer sash includes a first edge and a second edge spaced a first distance from the first edge along a direction perpendicular to a plane defined by the first surface of the glazing, the outer sash including at least one groove defined by an opening and a first groove wall and a second groove wall spaced from the first groove wall, the groove extending into the outer sash between the first edge of the outer sash and the second edge of the outer sash, the groove having a longitudinal axis extending in a direction parallel to the plane defined by the first surface of the glazing;

an inner sash having a first portion adjacent the second surface of the glazing, the inner sash including a first edge and a second edge spaced a distance from the first edge along a direction perpendicular to a plane defined by the second surface of the glazing, the inner sash including at least one groove defined by an opening and a first groove wall and a second groove wall spaced from the first groove wall, the groove extending into the inner sash between the first edge of the inner sash and second edge of the inner sash;

a removable binder extending along a perimeter of the outer sash and along a perimeter of the inner sash, the binder engaging the outer sash and the inner sash and mechanically coupling the outer sash and the inner sash together, the binder comprising at least a first protrusion and a second protrusion formed from a single component, the first protrusion received within the groove in the inner sash and the second protrusion received within the groove in the outer sash, the groove in the inner sash and the groove in the outer sash are parallel, each protrusion comprising a plurality of flexible barbs that are compressed when the protrusion mates with one of the at least one grooves of the inner sash and outer sash, the flexible barbs providing a force on respective first groove wall and second groove wall of the at least one groove of the inner sash and outer sash to couple the inner sash and outer sash together, wherein the binder is configured for removal for service of the sash assembly, and wherein the first and second protrusions extend respectively along substantially the entire perimeter of the inner sash and the outer sash.

9. The sash assembly of claim 8, wherein the binder is configured to seal where the inner sash and outer sash meet from at least one of moisture and air.

10. The sash assembly of claim 8, wherein the outer sash houses at least one pane of glass and removal of the binder allows for servicing of the glass.

11. The sash assembly of claim 8, wherein each protrusion comprises four barbs.

12. The sash assembly of claim 8, wherein the barbs being selected from the group consisting of flexible polyvinyl chloride, thermoplastic elastomer, flexible urethane, and rubber based material.

13. The sash assembly of claim 8, wherein the binder comprises a plurality of edge binding members and corner binding members.

14. The sash assembly of claim 8, wherein the binder facilitates attachment of window hardware, retention of screws, and retention of weather stripping.

15. The sash assembly of claim 8, wherein the binder is located proximate to an outside portion of the sash assembly.

16. A sash assembly, comprising:

a glazing having a first surface defining a plane, and a second surface spaced from and parallel with the first surface;

an outer sash comprising at least one groove having an opening and a first groove wall and a second groove wall spaced from the first groove wall, the groove located in the outer sash, the at least one groove having a longitudinal axis extending in a direction parallel to the plane defined by the first surface of the glazing;

an inner sash comprising at least one groove having an opening and a first groove wall and a second groove wall spaced from the first groove wall, the groove located in the inner sash, the groove in the inner sash and the groove in the outer sash are parallel; and a binder extending along a perimeter of the outer sash and inner sash, the binder removably engaging the outer sash and the inner sash and mechanically coupling the outer sash and the inner sash together, the binder comprising a plurality of protrusions, each protrusion mating with one of the at least one groove in the inner sash and the at least one groove in the outer sash, each protrusion comprising a plurality of flexible barbs that are compressed when the protrusion mates with one of the at least one grooves in the inner sash and the outer sash, the flexible barbs of each protrusion providing a force on the respective first and second groove walls of each groove coupling the inner sash and outer sash together, and wherein the plurality of protrusions extend respectively along substantially the entire perimeter of the inner sash and the outer sash.

17. The sash assembly of claim 16, wherein the binder seals where the inner sash and outer sash meet from at least one of moisture and air.

* * * * *